US005275463A

United States Patent [19]

Rocha

[11] Patent Number: 5,275,463

[45] Date of Patent: Jan. 4, 1994

[54] COVER FOR LOUNGE CHAIR

[76] Inventor: Nicasio I. Rocha, 14004 Mandarin Oaks La., Jacksonville, Fla. 32223-2517

[21] Appl. No.: 884,767

[22] Filed: May 18, 1992

[51] Int. Cl.[5] ..... A47C 31/10

[52] U.S. Cl. ..... 297/229; 297/188; 297/228.12

[58] Field of Search ..... 297/188, 219, 229, 225, 297/228

[56] References Cited

U.S. PATENT DOCUMENTS

| | | | |
|---|---|---|---|
| 4,273,380 | 6/1981 | Silvestri | 297/229 X |
| 4,518,198 | 5/1985 | Daniels | 297/229 |
| 4,553,785 | 11/1985 | Duke, Jr. et al. | 297/188 X |
| 4,687,248 | 8/1987 | Ross et al. | 297/188 X |
| 4,725,094 | 2/1988 | Greer | 297/229 |
| 4,877,288 | 10/1989 | Lee | 297/229 |
| 4,892,353 | 1/1990 | Goddard | 297/188 X |

*Primary Examiner*—Peter R. Brown

*Attorney, Agent, or Firm*—Arthur G. Yeager; Earl L. Tyner

[57] ABSTRACT

A lounge chair cover which can be rolled up and fastened so as to be carried like a duffel bag, the cover including a panel to cover the top of the chair back, seat, and leg rest portions, having a hood pocket into which the top of the back portion of the chair fits, a pocket member hanging from the top which can serve as an attached pillow cover; a lateral back strap to stretch the cover taut across the back portion, and spaced strap members on the lower leg portion releasably connected together, preferably by hook and loop fasteners, longitudinal strap members along the lateral edges of the lower part of the main panel to fasten the panel smoothly and tautly to the leg rest portion of the chair; a pair of side pockets hanging downwardly from opposite sides of the seat portion of the cover, a pair of strap handles and cross reinforcing straps, and a strap closure member to hold the cover in a rolled form of a duffel bag with all pockets and their contents inside the roll.

20 Claims, 5 Drawing Sheets

COVER FOR LOUNGE CHAIR

BACKGROUND OF THE INVENTION

Beach chairs or lounge chairs are favorite pieces of furniture which are used by those resting on the beach or around a pool, or any other place where one can acquire a sun tan during leisure time. Usually the person reclining on the lounge chair wants a towel to cover the chair in order to provide a more comfortable environment in which to relax, avoiding the tacky feeling of plastic and the more harsh feeling of wood, and to absorb any perspiration or dripping water. Loose towels, however, become easily disarranged in use and by gravity or by the wind, or can become dirty by falling off the chair. Accordingly, dedicated sun tan enthusiasts have demanded some way to attach the towel to the chair. Clips have been used and more recently there have been offered fitted covers which can be attached to or removed from the lounge chair easily and quickly, and therefore can be carried with the person and taken home for washing. Such covers are disclosed in U.S. Pat. Nos. 4,536,028; 4,553,785; 4,671,568; and 4,725,094; and Des. 271,266 and Des. 286,486. While each of these patents show useful and pleasing chair covers, they do not meet all the requirements of a discerning user. The chair cover of the present invention is believed to be such an article of manufacture.

It is an object of this invention to provide an improved lounge chair cover. It is another object of this invention to provide an improved lounge chair cover that can be folded and rolled into a convenient shape for carrying as a duffel bag with associated articles inside the bag. Still other objects will become apparent from the more detailed description which follows.

BRIEF SUMMARY OF THE INVENTION

This invention relates to a unitary cover for a lounge chair, beach chair, and the like having a back portion, a seat portion, and a leg rest portion comprising:

A. an elongated main body panel for covering the chair including an upper section for covering the back portion of the chair and a lower section for covering the seat portion and leg rest portion of the chair, said upper and lower sections being joined in the region covering the seat portion of the chair;

B. a hood portion including a short back panel fastened along its edges to the corresponding edges of the upper section of the main body panel to provide a pocket for receiving therein the upper extremity of the back of the chair;

C. lateral strap means having two connectible ends attache to the lateral edges of the main body panel respectively, and positioned to extend across the back of the chair below said hood mean to provide a tautness to said main body panel;

D. a pocket means attached to said main body panel adjacent the top thereof to selectively hang downward behind the chair back as a storage pocket or to lie on top of said main body panel as a pillow cover;

E. longitudinal connectible strap means attached to said lower section including a pair of straps positioned respectively along the lateral edges of said lower section selectively connectible to straps on the lower edge of the lower section of the cover to provide a tautness to the cover adjacent the seat portion of the chair;

F. a pair of pockets respectively attached to and adapted to hang downwardly from opposite lateral edges of said main body panel adjacent the section covering the seat portion of the chair;

G. closure strap means extending laterally across said main body panel substantially midway of the two ends thereof and adapted to hold said cover in the form of a roll when the cover is removed from the chair and rolled up for storage or transportation of the cover and its contents; and H. a loop handle attached to said cover adjacent said closure for manually carrying said closed and rolled cover.

In preferred embodiments of the invention the various strap means include an elastic portion and/or a length adjustment means to provide versatility in use on any of several types and sizes of chairs; and strap elements which attach to other strap elements by means of Velcro fasteners (fabric hooks and fabric loops). The cover is, of course, preferably made of terry cloth to give the smooth feel of a quality towel.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The invention is best understood in the following description which refers to the attached drawings using unique numbers for various components of the invention.

Figure 6:
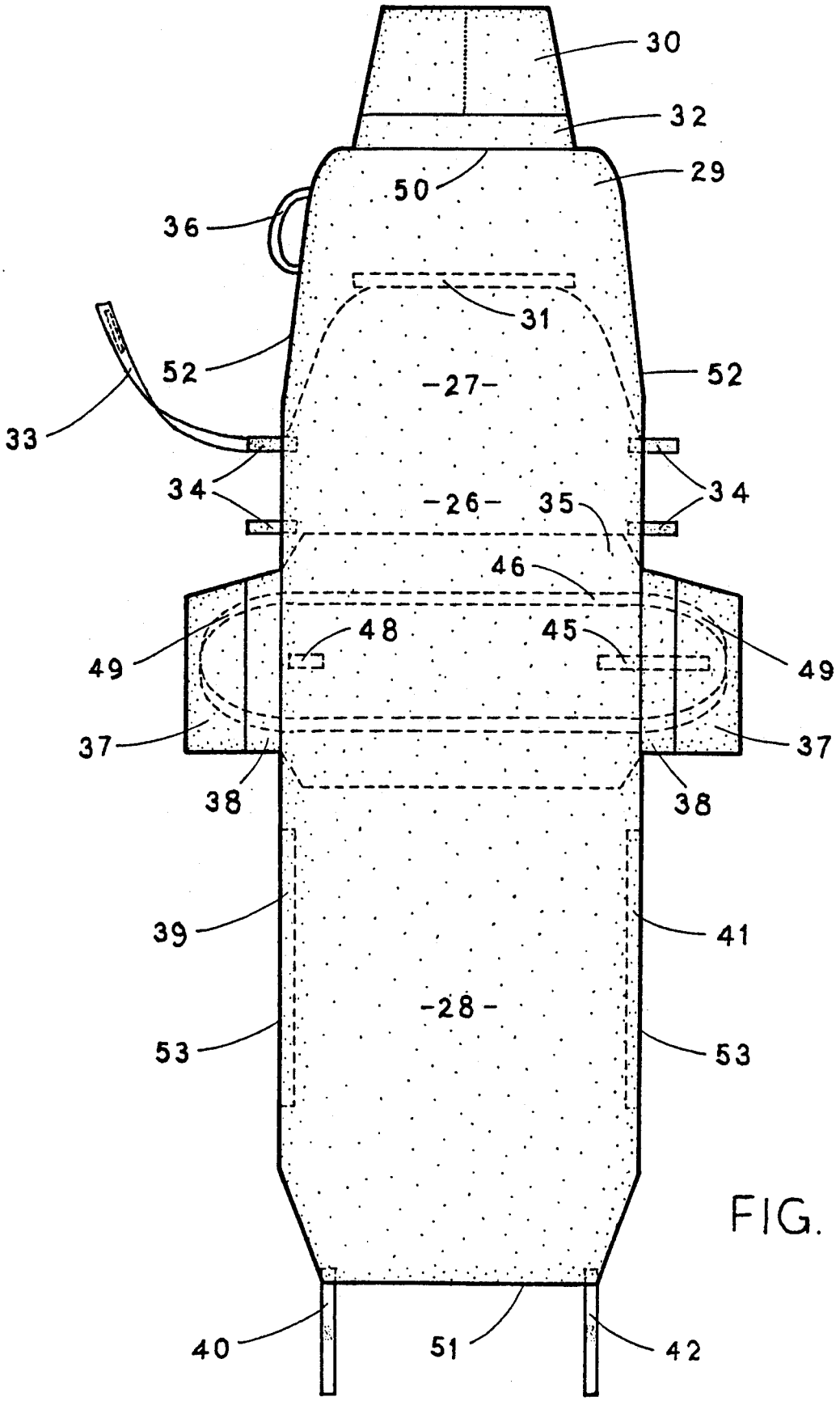
FIG. 6 is a top plan view of the cover laid flat.
Figure 7:
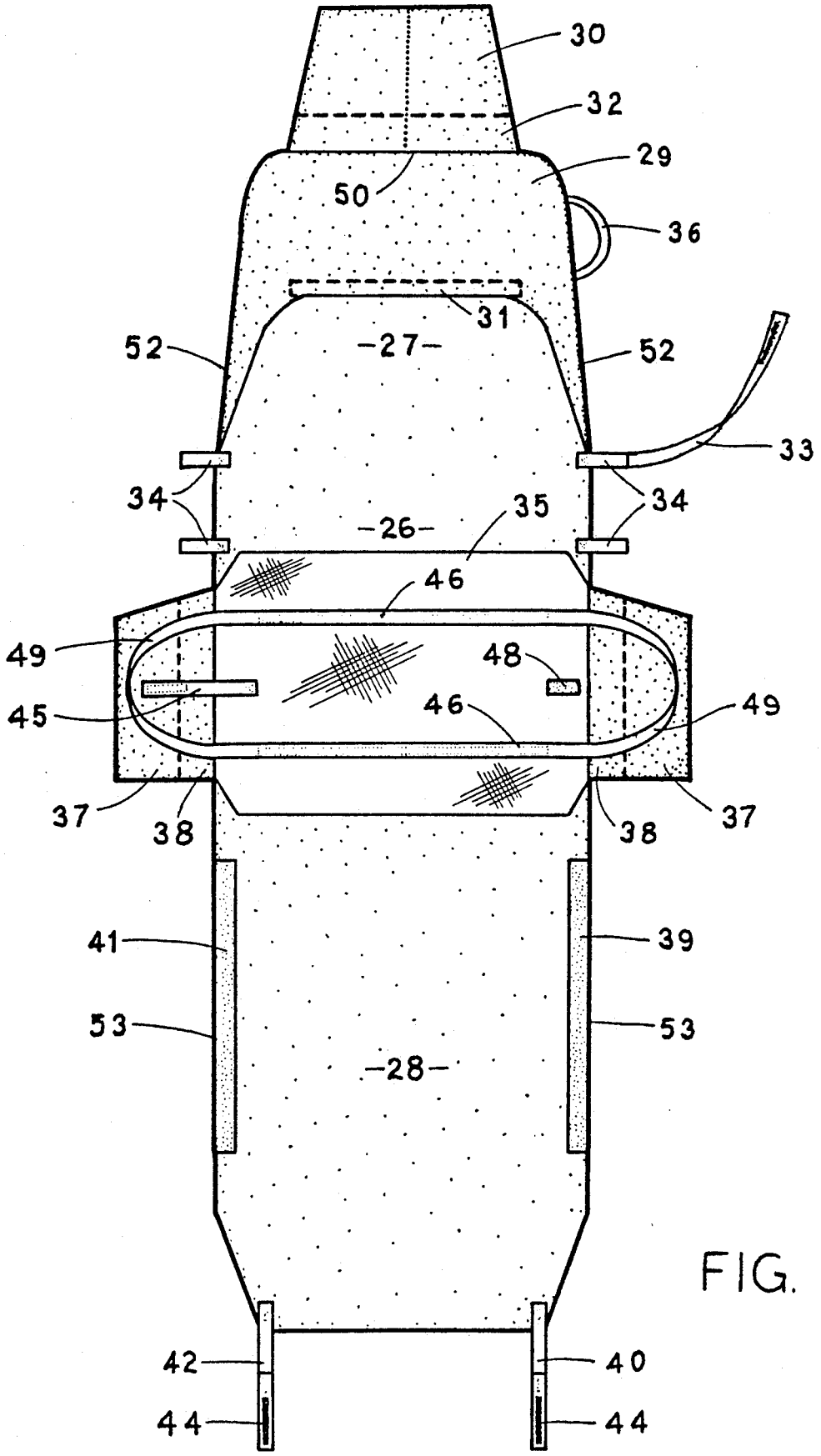
FIG. 7 is a bottom plan view of the cover laid flat.

FIGS. 6 and 7 show the chair cover of this invention stretch out flat and viewed from above in FIG. 6 and from below in FIG. 7. By "above" is meant the side on which the sun bather lies. By "below" is meant the side which contacts the lounge chair.

The cover essentially is a rectangular piece of fabric, preferably terry cloth, so as to provide the softness of a high quality towel. The cover, therefore, comprises a main body panel 26 having an upper section 27 to cover the back portion 23 of the lounge chair 22, and a lower section 28 to cover the leg rest portion 25 of the lounge chair 22. The lower part of upper section 27 and the upper part of lower section 28 combine to cover the seat portion 24 of the lounge chair 22. It is, of course, entirely possible to make main body panel 26 in three sections to cover the three portions 23, 24 and 25 of the lounge chair 22; but for simplicity main body panel 26 is all one piece or, at the most, two pieces sewed together generally across the lengthwise middle of the cover.

Across the upper portion 27 on the back side is a hood formed by back panel 29 being sewed around its lateral and top edges to main body panel 26 and with back panel edge 31 not sewed to main body panel 26 so as to form a hood or pocket into which the upper end of the back portion 23 of the lounge chair 22 may be slid. Preferably edge 31 is fitted with an elastic tape, or the like, so as to stretch back panel 29 taut so as to cling to the chair back.

On upper end 50 of the upper section 27 of main body panel 26 there is attached, preferably by sewing, a pocket 30 which may hang loose on the back side of the chair with one or more internal compartments to hold whatever the sunbather wishes to keep therein. Pocket 30 may also be flipped over to lie against upper section 27 and serve as a pillow cover by filling the pocket or pockets in flap 30 with a pillow or with loose cloth, such as a towel. Preferably, pocket 30 has a flap cover 56 which is closeable by Velcro fastener portions.

In order to hold upper section 27 securely taut against back portion 23 of the lounge chair 22, there is a strap 33 fastenable to any selected pair of tabs 34 on lateral edges 52. The two ends of strap 33 are fastenable to any of tabs 34 which are spaced apart lengthwise to provide options for attachment across the back of the chair. Preferably strap 33 is elastic so as to provide an automatic tightening for panel 26. Strap 33 and tabs 34 are shown with Velcro fastener patches. It is, of course, entirely acceptable to employ any other type of fastener appropriate to connect straps, such as, snaps, buckles, hooks, and eyes, buttons, etc.

Lower section 28 is attached to leg rest portion 25 of lounge chair 22 by two pairs of connectible longitudinal straps, preferably carrying Velcro fastener pads. Strips or straps 39 and 41 are sewed along the left and right lateral edges 53, respectively, from the vicinity of the seat portion 24 to the lower part of lower section 28. Straps 40 and 42 are sewed to the lower edge 51 of lower section 28 on the left and right corners, respectively. Straps 39 and 40 are connectible to each other and straps 41 and 42 are likewise connectible to each other to stretch main body panel 28 lengthwise to cover the chair frame securely and tautly. The connectible fasteners shown here are Velcro fabric fasteners, the fabric loop portion being on straps 39 and 41, and the fabric hook portion 44 being on straps 40 and 42. Other types of fasteners are acceptable substitutes, such as bayonet snap fasteners, hooks and eyes, buttons, snaps, buckles, etc. A length adjustment buckle, may be employed to make it easier to adjust the cover to any size and structure of lounge chair. Straps 40 and 42 may be elastic.

Generally midway lengthwise of panel 26 at the general location of the seat portion of lounge chair 22, there are two flap pockets 37 attached respectively, to opposite lateral edges 52 or 53 of panel 26. These are utility pockets to hold whatever the sunbather wishes to take along, e.g., sun tan lotion, comb, book, eye shade, dark glasses, etc. Preferably, each pocket 37 has a closure flap 38 which may employ Velcro fastener pads to keep the pockets 37 closed and yet readily openable.

Figure 1:
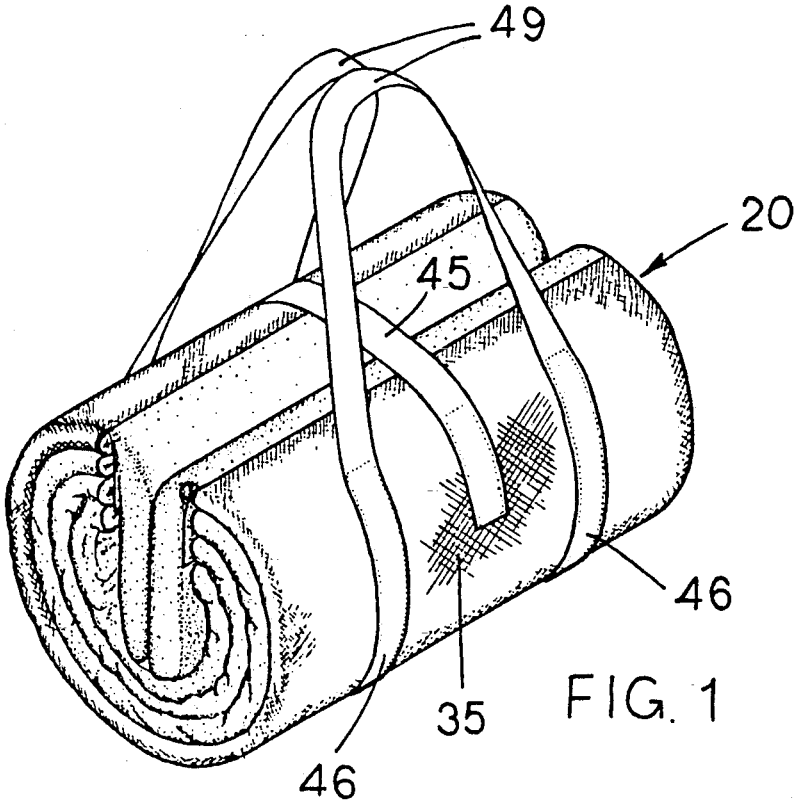
FIG. 1 is a perspective view of the cover of this invention rolled a for carrying.

When the cover is folded and rolled for carrying or for storage there is a need for closure strap 45 connectible to a tab 48, preferably by Velcro fabric fasteners to hold the folded and rolled cover in that position as shown in FIG. 1. Strap 45 and tab 48 are attached to the back side of panel 26. It is, of course, entirely acceptable to employ two straps and any of various fasteners as indicated above, to hold the cover in a closed, rolled disposition.

It is preferred to employ an outside wear panel 35 to the cover so that when it is rolled (as in FIG. 1) for storage and transportation panel 35 will take the wear and tear and protect the cover for future use. Preferably panel 35 is a wear resistant and stain resistant material such as a nylon oxford fabric.

Another preferable but not necessary feature is loop 36 attached to an edge of upper section 27 for the purpose of temporarily hanging a towel or other article therefrom.

Also attached to the back side of panel 26 are two loop strap handles 49 connected by reinforcement straps 46 sewed laterally across the backside of body panel 26.

Other features that may be added to this cover include but are not limited to: (1) a shoulder strap for convenience in carrying the rolled cover, (2) a ring near pocket 37 for holding a beverage can, (3) a snap hook to which a key ring may be attache (4) a money pocket, and the like.

It may be seen that the cover of this invention in the rolled up arrangement 20 as shown in FIG. 1 is similar to the familiar duffel bag frequently used by sun bathers to carry a towel and other items to the sun bathing location.

Figure 2:
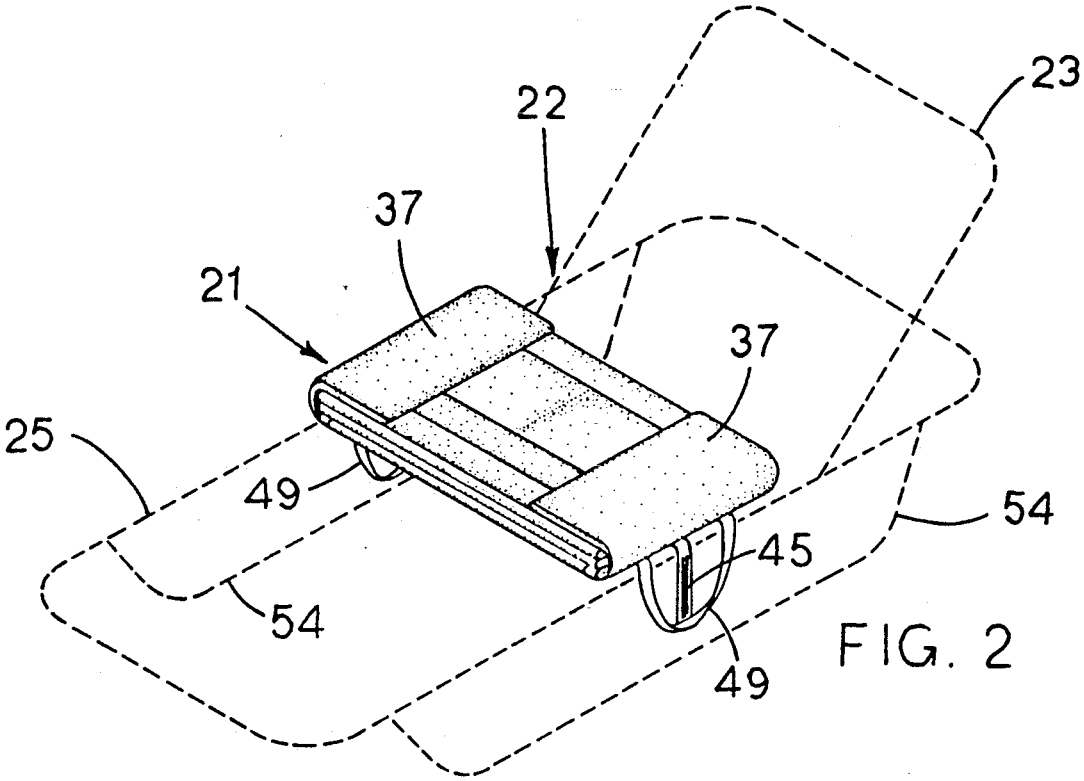
FIG. 2 is a perspective view of the first step in opening the closed cover of FIG. 1 and applying it to a lounge chair.

When opening the roll 20 on a lounge chair 22 having a back portion 23, a seat portion 24, a leg rest portion 25, and legs 54, the appearance is as shown in FIG. 2 with pockets 37 not yet unfolded and with strap handles 49 and closure strap 45 hanging downwardly.

Figure 3:
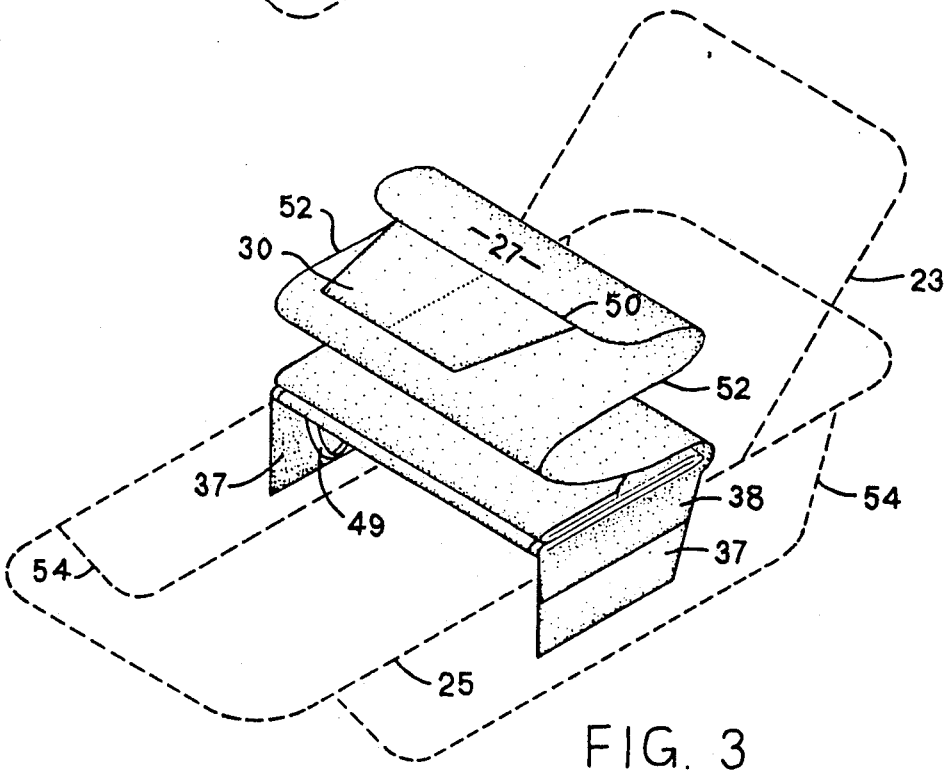
FIG. 3 is a perspective view of the second step in unrolling the cover to apply the upper section of the main body cover to the chair back.

FIG. 3 shows the partially unfolded roll on the lounge chair 22 with pockets 37 hanging downwardly from each side, and with upper section 27 being unfolded for application to back portion 23.

Figure 4:
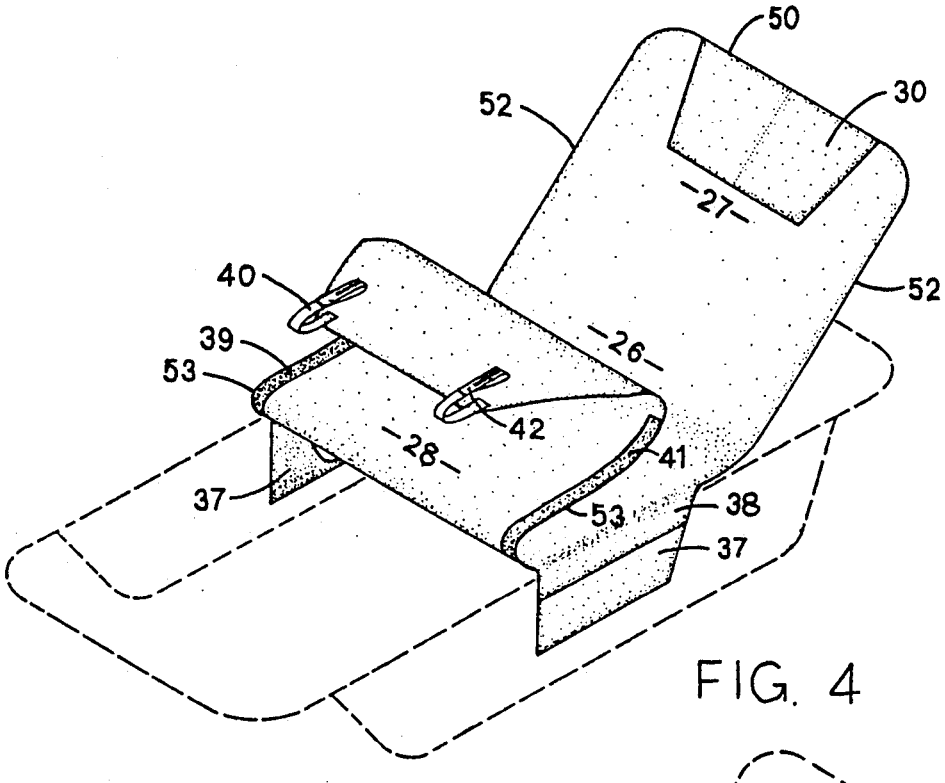
FIG. 4 is a perspective view of the third step in unrolling the lower section of the cover for attachment to the chair.

FIG. 4 shows upper section 27 in place over back portion 23 and with lower section 28 being unfolded for application to seat portion 24 and leg rest portion 25.

Figure 5:
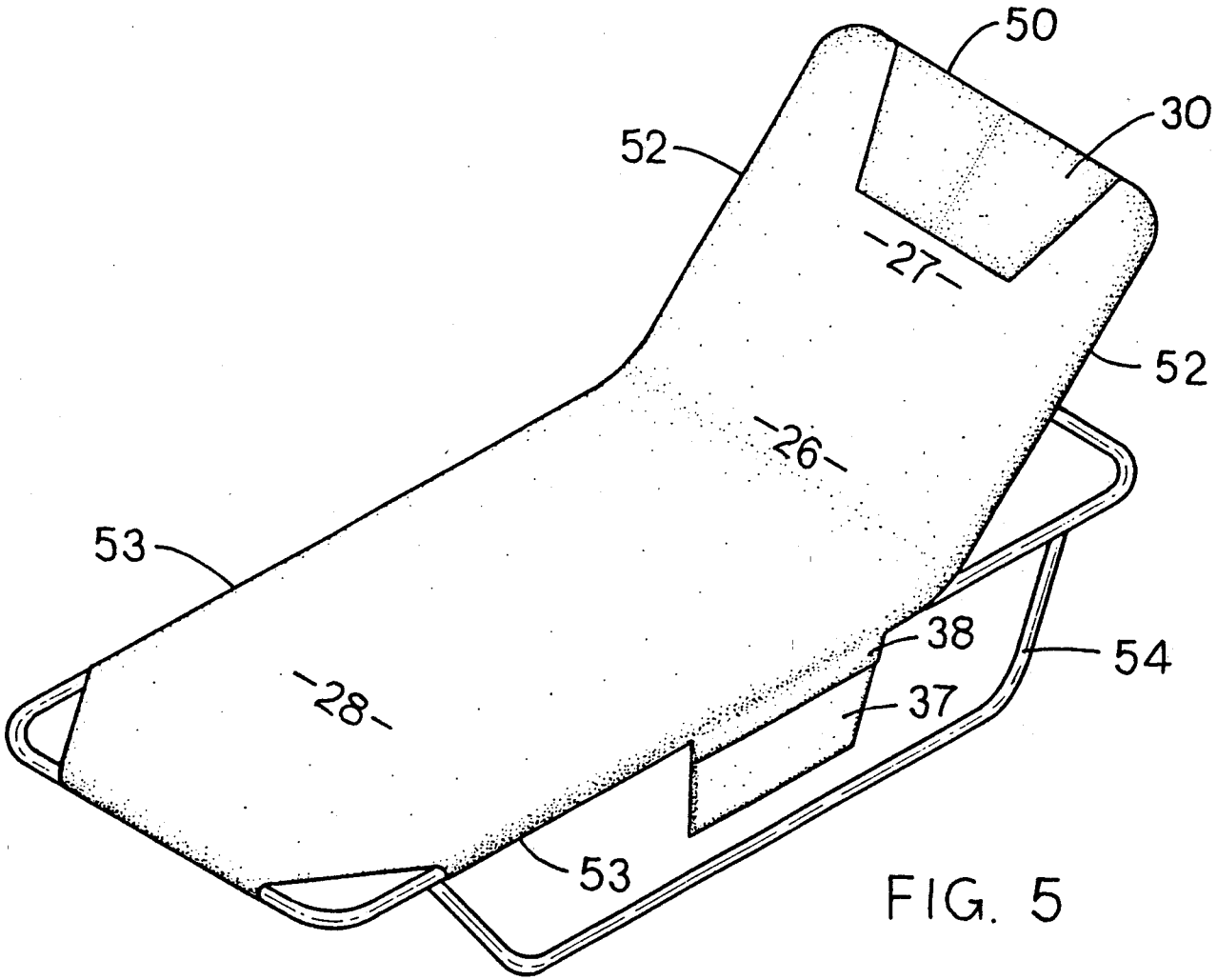
FIG. 5 is a perspective view of the chair with the cover fully attached.

FIG. 5 shows the entire cover after application to the lounge chair and ready for the sunbather.

There are, of course, many designs of lounge chairs, most of which being made of aluminum or plastic tubing with back portions pivotable from horizontally flat to an upright back support, and often with some adjustment in the position of the leg rest. Such are the types the cover of this invention has been designed to cover.

The cover/tote of this invention is particularly advantageous in its versatility in being usable with almost any design of lounge chair. It is also of particular importance to note that when rolled up in its carrying position (FIG. 1) all pockets and their contents are completely inside the roll.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A unitary cover for a lounge chair, beach chair, and the like having a back portion, a seat portion, and a leg rest portion comprising:

A. an elongated main body panel for covering the chair including an upper section for covering the back portion of the chair and a lower section for covering the seat portion and leg rest portion of the chair, said upper and lower sections being joined in the region covering the seat portion of the chair;

B. a hood portion including a short back panel fastened along its edges to the corresponding edges of the upper section of the main body panel to provide a pocket for receiving therein the upper extremity of the back of the chair;

C. lateral strap means having two connectible ends attached to the lateral edges of the main body panel respectively, and positioned to extend across the back of the chair below said hood means to provide a tautness to said main body panel;

D. a pocket means attached to said main body panel adjacent the top thereof to selectively hang downward behind the chair back as a storage pocket or to lie on top of said main body panel as a pillow cover;

E. longitudinal strap means attached to said lower section including a pair of straps positioned respectively along the lateral edges of said lower section selectively connecting the lower edge of the lower section of the cover to the cover adjacent the seat portion of the chair;

F. a pair of pockets respectively attached to and adapted to hang downwardly from opposite lateral edges of said main body panel adjacent the section covering the seat portion of the chair;

G. closure strap means extending laterally across said main body panel substantially midway of the two ends thereof and adapted to hold said cover in the form of a roll when the cover is removed from the chair and rolled up for storage or transportation of the cover and its contents; and H. a loop handle attached to said cover for manually carrying said closed and rolled cover.

2. The chair cover of claim 1 wherein said lateral strap means includes as a portion thereof an elastic strap.

3. The chair cover of claim 1 wherein said longitudinal strap means attached to said lower section includes as a portion thereof an elastic strap.

4. The chair cover of claim 1 wherein said longitudinal strap means includes a first pair of straps attached to said lower section adjacent said seat portion of the chair, a second pair of straps attached to the lower end of said lower section and cooperating fabric hook and loop fasteners attached to said two pairs of straps to be respectively connectible to form one strap along each lateral edge respectively of said lower section to hold it snugly to said seat and leg rest portions.

5. The chair cover of claim 4 wherein said means includes a length adjustment means on each of said pair of straps.

6. The chair cover of claim 1 wherein said hood portion includes an elastic lateral edge portion to provide tautness of the main body cover laterally across said upper section.

7. The cover of claim 1 wherein said two connectible ends of said lateral strap means are connectible by way of fabric hook and fabric loop fasteners.

8. The cover of claim 1 wherein said closure strap means includes cooperating fasteners of fabric hooks and fabric loops.

9. The cover of claim 1 wherein said pocket means and said pair of pockets include a manually operable closure for each pocket.

10. A soft, washable chair cover for a lounge chair having a seat portion, a back portion pivotable from an upright vertical position to a flat horizontal position, and a leg rest portion extending generally horizontally outward from said seat portion, oppositely from said back portion; said cover comprising:

A. a unitary body panel of a size to extend over said back portion, said seat portion and said leg rest portion of the lounge chair;

B. a hood member comprising a back partial panel sewed to said body panel to form a pocket for insertion of a part of said back portion therein;

C. a pair of connectible lateral strap members sewed respectively to each lateral edge of said main body panel and adapted to be connected across said back portion;

D. two pairs of connectible longitudinal strap members positioned along the lateral edges of said main body panel and adapted to stretch said body panel over said seat portion and said leg rest portion;

E. a pair of side pockets sewed to said main body panel and adapted to hang downwardly along opposite sides respectively of said seat portion;

F. a head pocket member sewed to the upper edge of said main body panel and adapted to hang selectively down behind said hood member or rest against said main body panel as a pillow cover;

G. a pair of lateral closure strap members midway between the ends of said main body panel and adapted to maintain said cover in a rolled storable and transportable disposition; and H. a pair of strap loop handles attached to reinforcement strap extending laterally across said cover adjacent said closure strap and adapted for carrying said cover in its rolled disposition.

11. A cover of claim 10 wherein one of said lateral strap members is elastic.

12. A cover of claim 10 wherein one strap of each pair of longitudinal straps is elastic.

13. A cover of claim 10 wherein said pair of lateral strap members and said pair of closure strap members each include fasteners of fabric hooks and fabric loops.

14. A cover of claim 10 wherein each pair of longitudinal strap members is fitted with a first fastener member which is adapted to cooperate with a second fastener member to join the straps of each pair.

15. A unitary cover for a beach lounge chair having a back portion, a seat portion, and a leg rest portion comprising: an elongated main body panel for covering a chair including an upper section for covering a back portion of a chair and a lower section having a seat portion and a leg rest portion, a short back panel fastened along its upper and side edges to corresponding edges of said upper section of said main body panel, said back panel and upper section forming a receptor for the upper extremity of a back of a chair, lateral strap means having two connectible ends attached to lateral edges of said upper section of said main body panel respectively, and positioned to extend generally across a back of a chair spacedly below a lower edge of said back panel to provide a tautness to said main body panel, a pocket means attached generally between said main body panel and back panel to selectively hang downward behind a chair back or to hang forwardly in front of a chair to provide a pillow member on top of said main body panel, and longitudinal strap means attached to said lower section including a pair of spaced long straps positioned respectively along lateral edges of said lower section and attached adjacent said seat portion and a pair of spaced short straps attached to a lower edge of said lower section of said cover and means for selectively connecting said long straps respectively to said short straps.

16. The cover of claim 15 further comprising a pair of pockets attached respectively to opposite lateral edges of said main body panel adjacent said lower section.

17. The cover of claim 16 further comprising a closure strap means extending laterally across said main body panel substantially midway thereof and adapted to hold said cover in the form of a roll when said cover is removed from the chair and rolled up for storage or transportation.

18. The cover of claim 17 further comprising a loop handle adjacent said closure strap means for manually carrying said closed and rolled cover as a duffle bag.

19. The cover of claim 18 which includes a roll cover panel of soil resistant material across said cover at said seat section and adapted to provide an outside layer when said cover is rolled for storage or transportation.

20. The cover of claim 15 wherein said means for selectively connecting said long straps to said short straps includes cooperating pads of fabric hooks and fabric loops for each said means adapted to hold said seat and leg rest portions snugly to said chair.

* * * * *